US005940062A

United States Patent [19]

Fisher et al.

[11] Patent Number: 5,940,062

[45] Date of Patent: Aug. 17, 1999

[54] METHOD AND APPARATUS FOR DRIVING A LIQUID CRYSTAL DISPLAY USING SPECIFICATION OF PIXEL MEAN SQUARE VOLTAGE

[75] Inventors: Yuval Fisher, Del Mar; Daniel Rogovin; Tsae-Pyng Janice Shen, both of Thousand Oaks, all of Calif.

[73] Assignee: Rockwell International Corporation, Costa Mesa, Calif.

[21] Appl. No.: 08/710,472

[22] Filed: Sep. 18, 1996

[51] Int. Cl.[6] ..... G09G 3/36

[52] U.S. Cl. ..... 345/100; 345/95

[58] Field of Search ..... 345/87, 88, 89, 345/92, 94, 98, 100, 103, 50; 349/33, 34, 39, 41, 42

[56] References Cited

U.S. PATENT DOCUMENTS 5,459,495 10/1995 Scheffer et al. ..... 345/89

FOREIGN PATENT DOCUMENTS 0595495 5/1994 European Pat. Off. .

*Primary Examiner*—Chanh Nguyen

*Attorney, Agent, or Firm*—Kyle Eppele; James P. O'Shaughnessy

[57] ABSTRACT

A method and an apparatus for driving a passive liquid crystal display to obtain a high contrast ratio for both still image and video modes includes driving some or all of the row lines simultaneously. The row voltage wave forms are defined as a set of orthogonal functions and the column voltage wave forms are defined as a linear combination of the row voltages. The mean square voltage across each pixel and row is specified, and the corresponding column coefficient is calculated from which all coefficients in a column can be determined.

6 Claims, 3 Drawing Sheets

METHOD AND APPARATUS FOR DRIVING A LIQUID CRYSTAL DISPLAY USING SPECIFICATION OF PIXEL MEAN SQUARE VOLTAGE

BACKGROUND OF THE INVENTION

This invention relates to a liquid crystal display and, more particularly, to a method and an apparatus for driving a passive liquid crystal display.

Large passive liquid crystal displays suffer from serious contrast problems due to the manner in which the display elements are actuated. A typical passive liquid crystal display 10 is shown in FIG. 1 in simplified schematic. A display panel 12 has a plurality of row electrodes or lines 14 extending perpendicular to a plurality of column electrodes or lines 16. The crossing points of the lines 14 and 16 define pixels 18 for displaying visual information. For illustration purposes, the display is shown as having four row lines 14, R1 through R4, and five column lines 16, C1 through C5. In practice there are often hundreds of rows and columns.

Voltages are applied to the column wires and the row wires, and a pixel is addressed when both its column and row are carrying a voltage. Liquid crystal display devices typically use what is generally referred to as "a line at a time" addressing method, which is depicted by the wave forms shown in FIG. 2. All of the column lines 16 are activated simultaneously by the application of a column voltage wave form $V_C(t_K)$ having a plurality of pulses. The row lines 14 are each turned on for a fixed period of time in sequence. Specifically, at a time $t_1$, a first row voltage wave form $V_{R1}(t_K)$ includes a pulse which is applied to the row line R1 while an associated column voltage pulse is applied to the column lines C1 through C5 such that all of the pixels 18 in the first row of the display panel 12 are activated. At a time $t_2$, after the first row voltage pulse has been terminated, a second row voltage wave form $V_{R2}(t_K)$ applies a pulse to the row line R2, while an associated column voltage pulse is applied to column lines C1 through C5 such that the second row of the pixels 18 in the display panel 12 is activated. Similarly, row voltage wave forms $V_{R3}(t_K)$ and $V_{R4}(t_K)$ apply pulses to the row lines R3 and R4 respectively; at the times $t_3$ and $t_4$, respectively, to activate the pixels 18 in the third and fourth rows, respectively. Once activated, the pixels remain at the same state for a limited period of time (referred to as the decay time).

In a large passive display, the pixels 18 located in the upper rows may have decayed entirely before the lower rows are addressed, such that the image in those upper row portions of the display will fade. This results in a low contrast ratio. This problem is partially solved by using liquid crystal materials whose states relax slowly in time. The problem assumes critical importance when the device is run in a video mode, where short response times are required, in direct contradiction to using slow response liquid crystals.

One can mitigate this problem with video mode operation by exciting some or all of the rows of the display panel simultaneously. The formulas typically used to generate the specified row and column voltages require a number of coefficients, with a particular coefficient being assigned to each pixel. These coefficients must be determined, and the challenge of determining all of the coefficients across all of the rows has limited the prior art ability to excite more than one row at a time for a given image. The prior art has attempted to overcome this problem to excite some or all of the rows by presetting the coefficients. However, for images that have more than one bit of gray scale, this has resulted in a coupling between the different pixels in a given column. This coupling manifests itself such that the required rms (root mean square) voltage to achieve a particular light transmission intensity in a given pixel depends on the state of all of the other pixels in that column. Decoupling the various pixels within a column from one another requires the use of a virtual row.

SUMMARY OF THE INVENTION

The present invention provides an apparatus and method for driving a liquid crystal display panel to display an image, wherein the coefficients are calculated. A straightforward calculation is necessary to determine one coefficient for each column. Once that column coefficient has been determined, however, the remaining coefficients within that column can be easily calculated. By relying on this mathematical realization, the present invention is able to provide exact solutions of the coefficients which generates a set of prespecified rms voltages.

In preferred embodiments, a computational engine (e.g. an ASIC) generates the row control signals using a set of orthogonal functions representing the row drive voltage wave forms as binary (ternary) wave forms, and generates column control signals as a linear combination of the row control signals. The highest contrast ratio is achieved if all of the row drive voltage wave forms are generated simultaneously.

The method for driving a liquid crystal display panel to display an image includes the steps of: a. reading information signals representing an image to be displayed and specifying the rms voltages for all pixels as well as particular row parameters: N (the number of rows) and F the row rms voltage; b. calculating mean square voltage averages for all column lines of a liquid crystal display panel; c. calculating mean square voltage variances for all the column lines of the liquid crystal display panel; d. calculating one coefficient for each of the column lines of the liquid crystal display panel, and then determining the others via Eq. (5); e. specifying voltage wave form for all row lines of the liquid crystal display panel to calculate instantaneous voltages for all of the column lines of the liquid crystal display panel using the column coefficients; and f. applying the instantaneous voltages to all of the row lines and all of the column lines of the liquid crystal display panel simultaneously to generate a display of the image.

The various features and advantages of this invention will become apparent to those skilled in the art from the following detailed description of the preferred embodiments. The drawings that accompany the detailed description are described as follows.

DETAILED DESCRIPTION OF THE PREFERRED EMBODIMENTS

Figure 1:
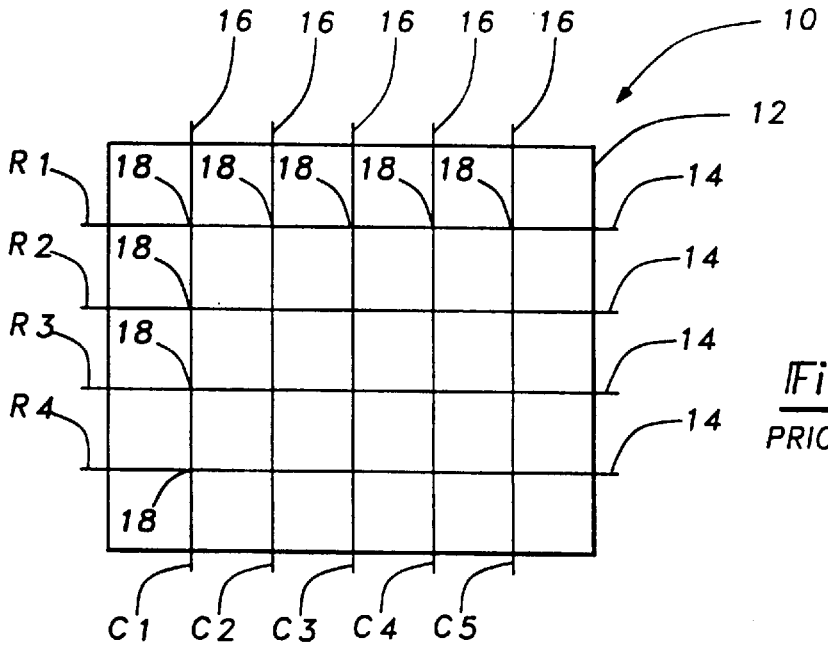
Fig-1 PRIOR ART
FIG. 1 is a schematic view of a prior art liquid crystal display panel.
Figure 2:
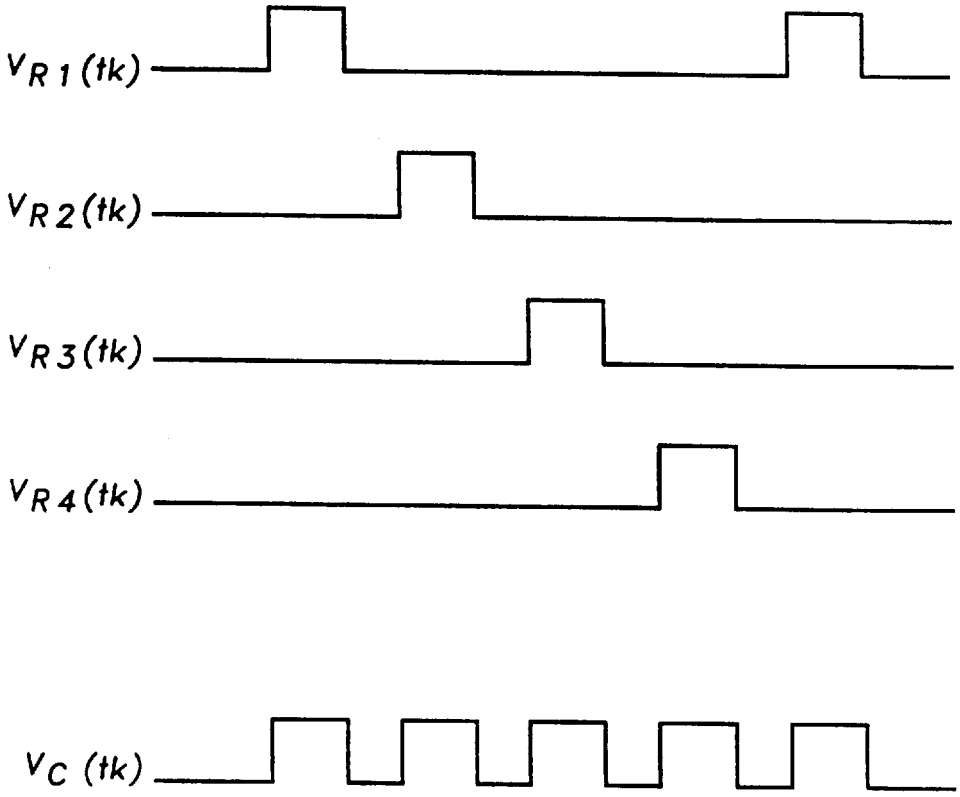
Fig-2 PRIOR ART
FIG. 2 is a wave form diagram of the addressing voltages applied to drive the row and column lines of the display panel shown in FIG. 1 as used in the prior art.
Figure 3:
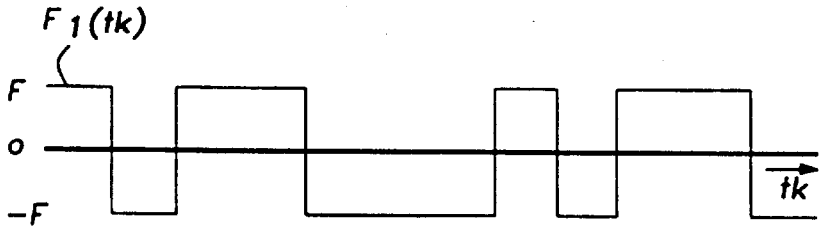
FIG. 3 is a wave form diagram of the row addressing voltages according to the present invention.
Figure 4:
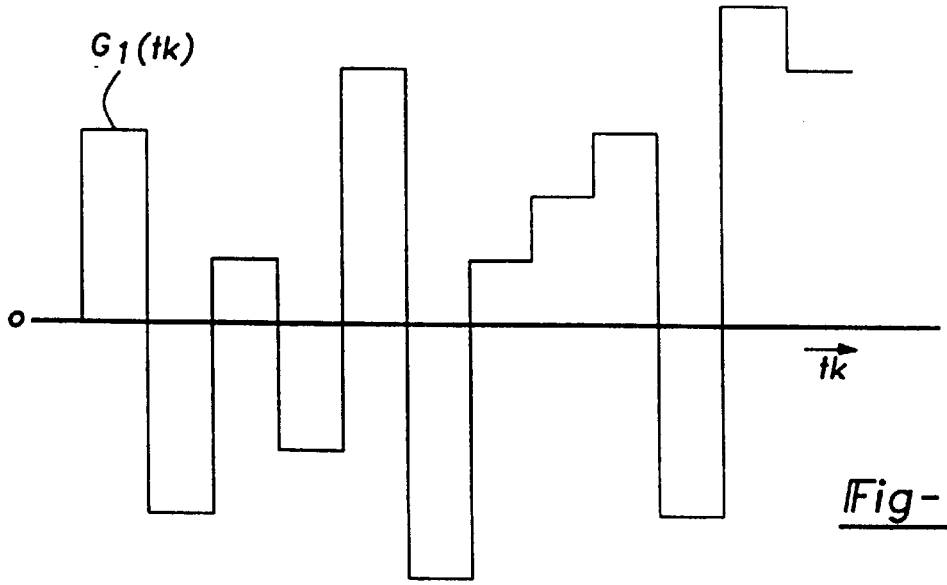
FIG. 4 is a wave form diagram of the column addressing voltages according to the present invention.

High contrast ratios in passive liquid crystal displays in a video mode can be achieved by exciting some or all of the rows at the same time. A set of orthogonal functions is used to represent the row voltages, and the column voltages are expressed as a linear combination of these row voltages. For example, $F_M(t_K)$ can represent any set of orthogonal functions defined on a collection of equal time intervals: $t_1$, $t_2$, . . . , $t_M$ ($M=2^q>N$, where q is an integer and N is equal to the number of rows in the display). The instantaneous voltage of the $J^{th}$ column during the time interval $t_K$ is defined by a first equation:

$$G_J(t_k) = \sum_{M=1}^{N} a_{J,M} F_M(t_k) \quad \text{(Eq. 1)}$$

where the variables $a_{J,M}$ are a set of real coefficients that will be calculated below. The two wave forms defined by the orthogonal functions have the general shape shown in FIG. 3, wherein $F_I(t_K)$ is the row voltage applied to the $I^{th}$ row line and in FIG. 4 wherein $G_J(t_K)$ is the column voltage applied to the $J^{th}$ column line.

$F_M(t_K)$ is selected to be a complete set of bilevel (trilevel) functions with values of ±F (±F, 0) and the time interval chosen for each segment (i.e., the $t_K$) is on the order of tens of microseconds. Thus, the row voltage drivers are typically digital devices and the column voltage drivers, since the column voltages are linear combinations of the row voltages, can be either analog or digital drivers.

The total instantaneous voltage across a pixel (I,J) at the time $t_K$ is defined by a second equation:

$$V_{I,J}(t_K)=F_I(t_K)-G_J(t_K). \quad \text{(Eq. 2)}$$

Liquid crystals exhibit approximately a mean square response to short time electrical excitations, and the mean square voltage across a pixel (I,J) is defined by a third equation:

$$\langle V_{I,J}^2 \rangle = F^2\left(1 + \sum_{M=1}^{N} a_{M,J}^2 - 2a_{I,J}\right) \quad \text{(Eq. 3)}$$

since the row functions are orthogonal. The third equation is of fundamental importance, as it links the image, through the mean square pixel voltage $<V^2_{I,J}>$, to the voltage wave forms via the coefficient $a_{I,J}$. Gray scale, or varying degrees of brightness of any one pixel, is obtained via amplitude modulation of the voltages.

An examination of the third equation reveals that there are two approaches for driving images on a panel: (1) either specify the coefficient $a_{I,J}$ by input image and use the third equation to calculate the mean square voltage $<V^2_{I,J}>$, or (2) specify the mean square voltage $<V^2_{I,J}>$ and use the third equation to calculate the coefficient $a_{I,J}$. The first approach is the prior art approach discussed above. The present invention uses the second approach.

It might appear that the second approach requires a great deal of extra calculations compared to the first approach to obtain all of the "a" coefficients necessary to generate an image on a liquid crystal display panel. This, however, is not the case. Applicants have discovered only one coefficient per column per frame must actually be calculated. To prove this conclusion, the third equation can be rewritten as a fourth equation in the following form:

$$2a_{I,J} + \frac{\langle V_{I,J}^2 \rangle}{F^2} = 1 + \sum_{M=1}^{N} a_{M,J}^2 = Q_J \quad \text{(Eq. 4)}$$

which demonstrates that the voltages $Q_J$ are independent of the row index "I". Therefore, the coefficients $a_{I,J}$ (the $I^{th}$ row) and $a_{L,J}$ (the $L^{th}$ row) for the $J^{th}$ column are related as shown in a fifth equation:

$$2a_{I,J} + \frac{\langle V_{L,J}^2 \rangle}{F^2} = 2a_{I,J} + \frac{\langle V_{L,J}^2 \rangle}{F^2} \quad \text{(Eq. 5)}$$

With this invention, the $<V^2_{I,J}>$ and $<V^2_{L,J}>$ terms are set by the image and thus known. Thus, it is necessary to calculate only one coefficient per column per frame and then use the fifth equation to obtain the remaining N−1 coefficients for a given column. Equations (9) and (10), below, are used to calculate the first coefficient.

Also, when using this approach it is possible to greatly increase the select/nonselect ratio, or voltage range available to achieve gray scale control. This invention is discussed in greater detail in co-pending application Ser. No. 08/743,378, entitled "Method and Apparatus for Enhancing the Select/Nonselect Ratio of a Liquid Crystal Display."

To solve for any one coefficient within a given column, the following quantity, set forth as a sixth equation, must be positive:

$$f_J^N(\langle V_{J,M}^2 \rangle; F) = \frac{4\sum_{M=1}^{N} \langle V_{J,M}^2 \rangle}{F^2} - \frac{\left(N\sum_{M=1}^{N} \langle V_{J,M}^2 \rangle\right) - \left(\sum_{M=1}^{N} \langle V_{J,M}^2 \rangle\right)^2}{F^4} - 4(N-1) \quad \text{(Eq. 6)}$$

for the coefficient $a_{I,J}$ to be real and thus the ms voltages $<V^2_{I,J}>$ to be real.

The first term on the right hand side of the sixth equation is just the total pixel mean square voltage average of the entire column. The next two terms on the right hand side of the sixth equation are the total pixel mean square voltage variance of the entire column.

Figure 5:
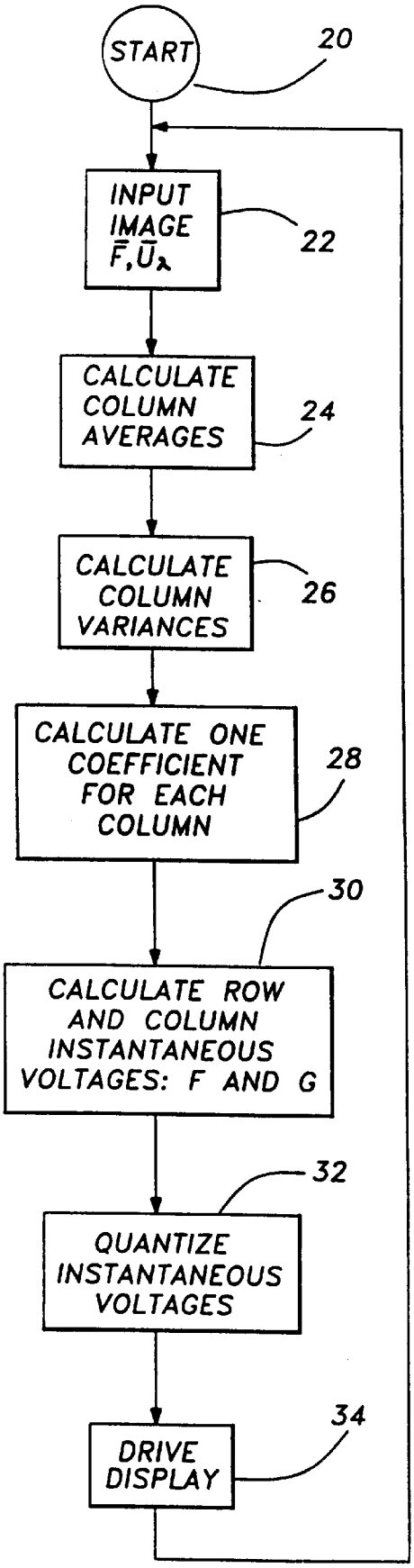
FIG. 5 is a flow diagram of the method of driving a liquid crystal display panel according to the present invention.

A flow chart of the method for driving a liquid crystal display panel to display an image is shown in FIG. 5. The method begins at a circle START 20 and enters an INPUT IMAGE (F, $U_\lambda$), where λ is a set of three indices which specify the gray scale and position of the pixel, instruction set 22 wherein the data for the image that is to be displayed on the liquid crystal display panel is read in as a set of gray scale pixel intensity and specify the rms voltage $U_\lambda$ for each pixel. The method then enters a CALCULATE COLUMN AVERAGES instruction set 24 wherein the rms voltages assigned for each gray scale value are used as represented by the first term on the right hand side of the sixth equation. The method then enters a CALCULATE COLUMN VARIANCES instruction set 26 where the variance of mean square pixel voltages for the entire column are calculated as represented by the next two terms on the right hand side of the sixth equation. The method next enters a CALCULATE ONE COEFFICIENT FOR EACH COLUMN instruction set 28 wherein the previously calculated values are used to calculate one $a_{I,J}$ coefficient for each column according to the ninth equation as set forth below. All of the other "a" coefficients in a given column are determined by using the fifth equation set forth above.

The method next enters a CALCULATE ROW AND COLUMN INSTANTANEOUS VOLTAGES: F AND G instruction set 30 to evaluate the column voltages $G_J(t_K)$, for each column "J" and each time interval $t_K$, according to the first equation set forth above. As previously stated, "N" is the number of rows and $F_M(t_K)$ is a complete set of discrete, orthogonal functions; e.g., the Walsh functions or the pseudorandom functions. The column voltages can be calculated using the equations (7)–(10). Thus, if all of the $a_{L,J}$ coefficients in the column "J" are referenced to a particular pixel in that column, say the pixel positioned in the row "L", then the column voltage can be written as a seventh equation:

$$G_J(t_k) = \left(a_{L,J} + \frac{\langle V_{L,J}^2 \rangle}{F^2}\right) R(t_k) - \frac{\sum_{M=1}^{N} \langle V_{J,M}^2 \rangle F_M(t_k)}{F^2} \quad \text{(Eq. 7)}$$

wherein $R(t_K)$ is defined by an eighth equation:

$$R(t_k) = \sum_{M=1}^{N} F_M(t_k) \quad \text{(Eq. 8)}$$

The $a_{L,J}$ coefficients are calculated using a ninth equation:

$$a_{L,J} = \frac{-\left(\sum_{M=1}^{N} X_{L,M}^J - 2\right) - \sqrt{\left(\sum_{M=1}^{N} X_{L,M}^J - 2\right)^2 - 4N\left(\frac{1}{4}\sum_{M=1}^{N} \{X_{L,M}^J\}^2 + 1 - \frac{\langle V_{L,J}^2 \rangle}{F^2}\right)}}{2N} \quad \text{(Eq. 9)}$$

where $X^1_{J,M}$ is defined by a tenth equation:

$$X_{L,M}^J = \left(\frac{\langle V_{L,J}^2 \rangle - \langle V_{M,J}^2 \rangle}{2F^2}\right) \quad \text{(Eq. 10)}$$

As mentioned above, the mean square voltage quantities are preset. F is the row rms (root mean square) voltage and is also known. Equations (9) and (10) are used to calculate one coefficient in each column. The other coefficients are then easily determined using Equation (5). After the column voltages have been computed, the method enters a QUANTIZE INSTANTANEOUS VOLTAGES instruction set 30 to generate the column and row drive voltages to the discrete column and row drivers. These quantized instantaneous drive voltages are applied to the column and row lines by a DRIVE DISPLAY instruction set 34, whereupon the dynamical response of the liquid crystal material rotates the directors in accordance with the instantaneous drive voltages. The method returns to the instruction set 22 to obtain the next image.

Figure 6:
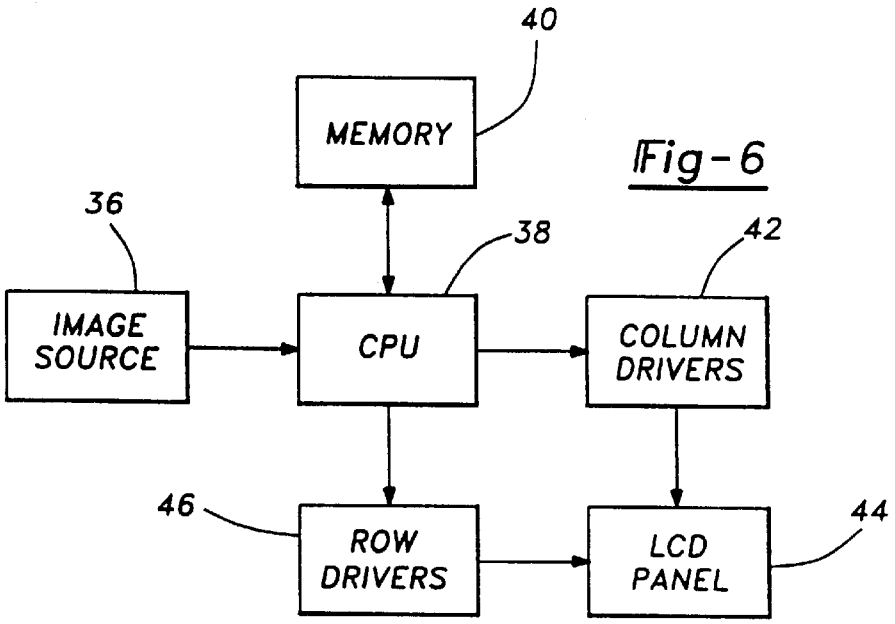
FIG. 6 is a schematic block diagram of an apparatus for driving a liquid crystal display panel according to the present invention.

An apparatus for driving a liquid crystal display panel in accordance with the present invention is shown in FIG. 6. A source of images 36 has an output connected to an input of a computational engine CE 38. The images source can be any type of conventional signal source, such as a control for a vehicle instrument panel, a television camera, or an optical storage device, which generates information signals representing an image to be displayed. The CE 38 has an input/output connected to an input/output of a memory 40 which stores an operating program for performing the method according to the present invention and the values calculated by the CE during execution of the operating program. A first output of the CE 38 is connected to an input of a column drivers circuit 42, which has an output connected to the column lines of a LCD (liquid crystal display) panel 44. A second output of the CE 38 is connected to an input of a row drivers circuit 46, which has an output connected to the row lines of the LCD panel 44. Thus, the CE 38 responds to the image information received from the images source 36 by generating control signals to the driver circuits 42 and 46. The driver circuits 42 and 46 respond to the control signals by generating all of the column and row drive voltage wave forms simultaneously to cause the image to be displayed by the LCD panel 44 with an enhanced select/nonselect ratio in accordance with the method according to the present invention. In actual implementation we have in mind that the CE will be an ASIC (Application Specific Integrated Chip).

The foregoing description is exemplary rather than limiting in nature. Variations and modifications of the disclosed embodiments will become apparent to those skilled in the art that do not depart from the purview and spirit of this invention. The scope of this invention is to be limited only by the appended claims.

What is claimed is:

1. A liquid crystal display panel to display an image comprising:

a computational engine having an input connected to a source of information signals representing an image to be displayed, said computational engine calculating column voltage coefficients, and for each column on a display panel, said computational engine being responsive to said information signals and said coefficients for generating column control signals at a first output and for generating row control signals at a second output;

column drivers having an input connected to said computational engine first output and being responsive to said column control signals for generating simultaneously a plurality of column drive voltage wave forms at an output;

row drivers having an input connected to said computational engine second output and being responsive to said row control signals for generating a plurality of row drive voltage wave forms at an output, said row drive voltage wave forms being generated simultaneously; and a liquid crystal display panel having a plurality of column lines connected to said column drivers output and a plurality of row lines connected to said row drivers output, the intersection of each said row line and each said column line defining a pixel, each of said panel column lines being responsive to one of said column drive voltage wave forms and each of said row lines being responsive to one of said row drive voltage wave forms for displaying the image represented by the information signals, wherein a total instantaneous voltage across a pixel intersection if a $J^{th}$ column line and an $I^{th}$ row line at a time $t_K$ is defined by an equation $$V_{I,J}(t_K) = F_I(t_K) - G_J(t_K)$$

$G_J(t_K)$ is the column drive voltage wave form applied to the $J^{th}$ column line defined by an equation $$G_J(t_K) = \left(a_{L,J} + \frac{\langle V_{L,J}^2 \rangle}{F^2}\right) R(t_K) - \frac{\sum_{M=1}^{N} \langle V_{J,M}^2 \rangle F_M(t_K)}{F^2}$$

$F_M(t_K)$ is a set of orthogonal functions defined on a collection of equal time intervals $t_1, t_2, \ldots, t_M$, $M=2^q>N$, where q is an integer and N is equal to the number of row lines in said panel, and the variables $a_{J,M}$ are a set of real coefficients, and are calculated by said computational engine.

2. A method for driving a liquid crystal display panel to display an image comprising:

a. reading information signals representing an image to be displayed;

b. calculating one coefficient for each of the column lines of the liquid crystal display panel, for example, the coefficient for the $J^{th}$ column line and an $L^{th}$ row is defined by an equation $$a_{L,J} = \frac{-\left(\sum_{M=1}^{N} X_{L,M}^J - 2\right) - \sqrt{\left(\sum_{M=1}^{N} X_{L,M}^J - 2\right)^2 - 4N\left(\frac{1}{4}\sum_{M=1}^{N} \{X_{L,M}^J\}^2 + 1 - \frac{\langle V_{L,J}^2 \rangle}{F^2}\right)}}{(2N)}$$

where $X^J_{J,M}$ is defined by the following equation:

$$X_{L,M}^J = \left(\frac{\langle V_{L,J}^2 \rangle - \langle V_{M,J}^2 \rangle}{2F^2}\right)$$

and then determining other coefficients for each column by the equation $$2a_{I,J} + \frac{\langle V_{I,J}^2 \rangle}{F^2} = 2a_{L,J} + \frac{\langle V_{L,J}^2 \rangle}{F^2};$$

c. specifying instantaneous voltages for all row lines of the liquid crystal display panel to calculate the instantaneous voltage for all of the column lines of the liquid crystal display panel using said column coefficients; and d. applying the instantaneous voltages to a plurality of row lines and a plurality of column lines of the liquid crystal display panel simultaneously to generate a display of the image.

3. The method according to claim 2 wherein the step b. is performed using a set of orthogonal functions representing row voltage wave forms.

4. The method according to claim 3 wherein a mean square voltage of each row and pixel is specified from which said one coefficient is calculated.

5. The method according to claim 2 wherein the step d. is performed by generating each of the instantaneous row voltages as a binary (ternary) wave form having positive and negative (as well as zero) values of a predetermined magnitude.

6. The method according to claim 2 wherein the step d. is performed by generating each of the instantaneous column voltages as a linear combination of the instantaneous row voltages.

* * * * *